United States Patent [19]

Goldzweig

[11] Patent Number: 4,874,156

[45] Date of Patent: Oct. 17, 1989

[54] HAND OR FOOT MANIPULATED SELF CLAMPING DEVICE

[76] Inventor: Abe Goldzweig, 14627 Hesby St., Sherman Oaks, Calif. 91405

[21] Appl. No.: 141,542

[22] Filed: Jan. 7, 1988

[51] Int. Cl.[4] ..... B25B 1/16

[52] U.S. Cl. ..... 269/158; 269/254 CS; 269/329

[58] Field of Search ..... 269/254 CS, 158, 159, 269/160, 329

[56] References Cited

U.S. PATENT DOCUMENTS

| | | | |
|---|---|---|---|
| 1,389,320 | 8/1921 | Rubinstein | 269/254 CS |
| 1,587,181 | 6/1926 | Pomeroy et al. | 269/254 CS |
| 1,704,603 | 3/1929 | Hartley | 269/254 CS |
| 1,720,416 | 7/1929 | Harvey | 269/254 CS |
| 2,949,947 | 8/1960 | Story | 269/254 CS |
| 2,952,282 | 9/1960 | McHenry | 269/254 CS |

*Primary Examiner*—Robert C. Watson

*Attorney, Agent, or Firm*—Walter Unterberg

[57] ABSTRACT

This combination holding tool and vise allows the operator, using hands and a foot pedal, to insert and adjust one or more work pieces between vise jaws before allowing spring pressure to hold the work pieces between the jaws in the holding tool mode. The arrangement permits the holding tool assembly with the work piece(s) to be transferred intact to another work station. Instead, the work piece(s) may be firmly gripped in their held position by advancing a rigid mechanical stop against one of the jaws, so that the holding tool now becomes a conventional vise. If desired, the vise assembly with the work piece(s) may be transferred to another work station. The combination has obvious advantages over a separate holding tool and vise in speeding up production and assembly operations, such as lower cost, ability to perform added operations on the work piece, and simplicity, so that it can be operated by handicapped, partially disabled people.

5 Claims, 3 Drawing Sheets

HAND OR FOOT MANIPULATED SELF CLAMPING DEVICE

BACKGROUND OF THE INVENTION 1. Field of the Invention

This invention relates to holding tools and vises, and in particular to a combination of both. In this invention the movable jaw of a vise is opened by foot against a spring force, leaving both hands free to insert and adjust one or more objects in the space between the jaws of the vise. When the foot is removed, the spring force causes the jaws to close on the object(s) so that the vise acts as a holding tool. Now a rigid mechanical stop placed against the movable jaw overrides the spring force and provides a positive vise grip on the object(s). 2. Prior Art With contemporary vises it is cumbersome for a person to hold one or more objects in a vise with one hand while tightening the vise with the other hand. Another disadvantage of existing vises is that an object cannot be adjusted in the vise without opening or closing the jaws. Thomas (U.S. Pat. No. 2,489,731) discloses a vise which is foot-operated, thereby freeing both hands. His vise requires the foot pedal to be pumped several times and his invention has no holding feature, so that the jaws still need to be opened and closed if adjustments are needed to place parts precisely in their proper position.

The drawbacks of some existing vises further include inability to be moved to a different work area with the work piece still in the vise. Overall, production efficiency is limited by the need for separate operations due to the inability of combining a holding tool and a vise.

SUMMARY OF THE INVENTION

Accordingly, it is an object of this invention to provide a combination holding tool and vise to facilitate and speed up production and assembly operations.

It is another object to provide a combination holding tool and vise which can be moved with a work piece held in its jaws from the original location to another location or process station.

It is a further object to provide a combination holding tool and vise in which the pressure on the work piece can be varied from a smaller holding pressure to a strong vise grip.

It is another object to provide a combination holding tool and vise which consists of a smaller number of parts and has a lower cost than a separate holding tool and vise.

Lastly, it is an object to provide a combination holding tool and vise which is simple to operate and suited to use by partially disabled people.

The present invention implements the above stated objects by a holding tool and vise combination consisting of a stationary jaw integral with a secondary base, a slotted slide with the movable jaw, a compression spring, a threaded shaft, and a stationary base. The slotted slide is slidably attached to the secondary base, able to slide along the secondary base to the extent of its slot. At one sliding extremity the movable jaw on the slotted slide and the stationary jaw on the secondary base are in the closed position; at the other extremity they are fully open. The two jaws are so arranged that they match each other in shape and height, and are completely equal and opposite.

On the slotted slide which moves horizontally along the secondary base the movable jaw stands vertically at one end while a similar vertical slide raise is fixedly attached at the other end. A compression spring inserted between the slide raise and the stationary jaw on the secondary base urges the slide raise away from the stationary jaw and simultaneously the movable jaw toward the stationary jaw, providing holding tool function through spring pressure. A threaded shaft, horizontal and parallel to the direction of sliding, resides in a threaded through-hole in the slide raise, with a shaft handle toward the outside or operator's side, and a shaft tip toward the stationary jaw. When the shaft is screwed forward to bring the tip in firm contact with the stationary jaw, a strong vise grip results, overriding the spring pressure. This is the principle of a combined holding tool and vise with the same pair of jaws.

In practice the secondary base with slidably attached slotted slide rests on a stationary base with a raised edge which retains the secondary base on the stationary base when the secondary base is pushed toward the raised edge, or when the slotted slide is pushed in that direction against spring pressure to open the jaws. Such a push is provided by the action of a foot pedal which pulls vertically on one leg of a pivot and rocker mechanism attached to the stationary base, the other leg moving horizontally in the stated direction and thus pushing on the slotted slide toward the stationary jaw, with the result that the moving jaw moves away from the stationary jaw, opening the vise gap. This foot pedal action leaves the hands free to insert or adjust one or more objects or work pieces in the oversize gap. When the objects are in the proper position, foot pedal action is stopped and the jaws close on the objects under spring pressure alone to provide a holding tool.

Now the shaft is screwed in the threaded hole in the slide raise to bring the shaft tip in firm contact with the stationary jaw (as described above) for a vise grip on the objects. The secondary base with attached slotted slide may now be lifted off the stationary base and moved to a new location with the objects firmly held in the jaws.

Thus the present invention can be used for all the purposes of a conventional vise and also as a holding tool. It facilitates the user's ability to manipulate several objects in the vise without the help of another person. The opening and closing of the jaws can be accomplished by pushing and relaxing the slotted slide either by a foot pedal via the pivot and rocker mechanism, or by any part of the user's body, such as hand or chest, or any appendage which a disabled person might be able to use.

It is seen that this invention satisfies the objects stated at the beginning of this section.

BRIEF DESCRIPTION OF THE DRAWING

The features of the invention are illustrated in the drawing which consists of several views numbered FIGS. 1 through 8, as follows.

DETAILED DESCRIPTION OF THE PREFERRED EMBODIMENT

Figure 1:
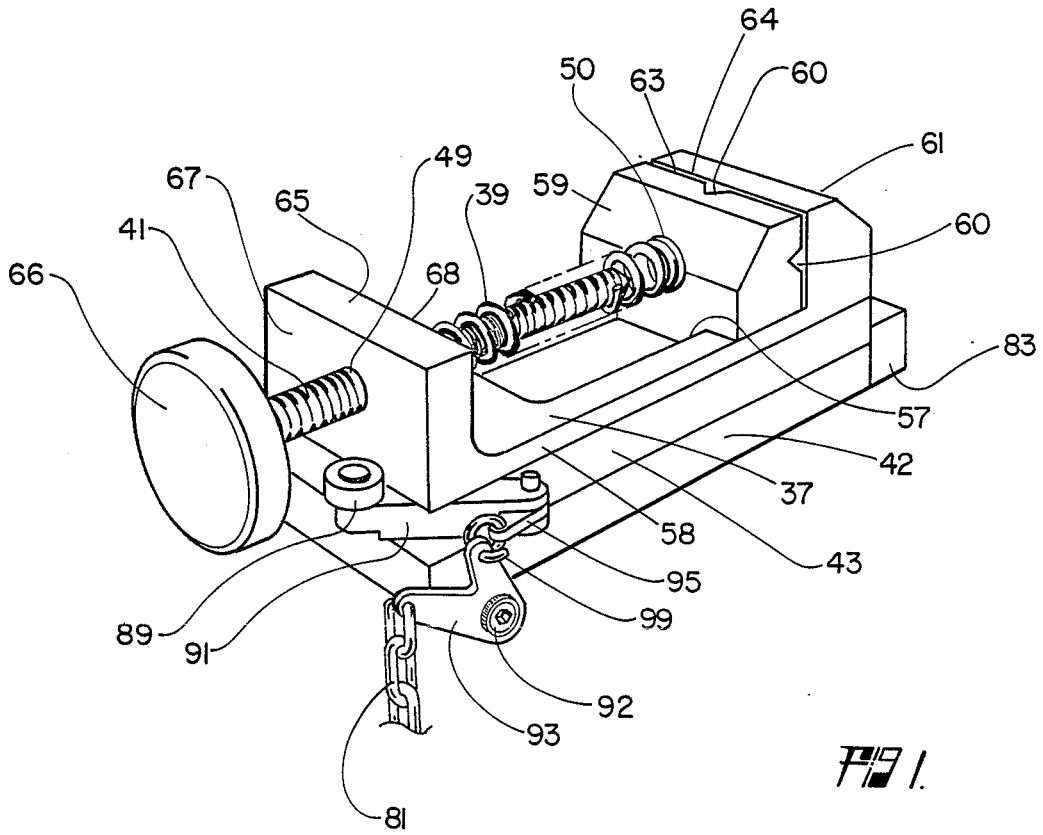
FIG. 1 Overall pictorial view of the holding tool and vise combination.
Figure 2:
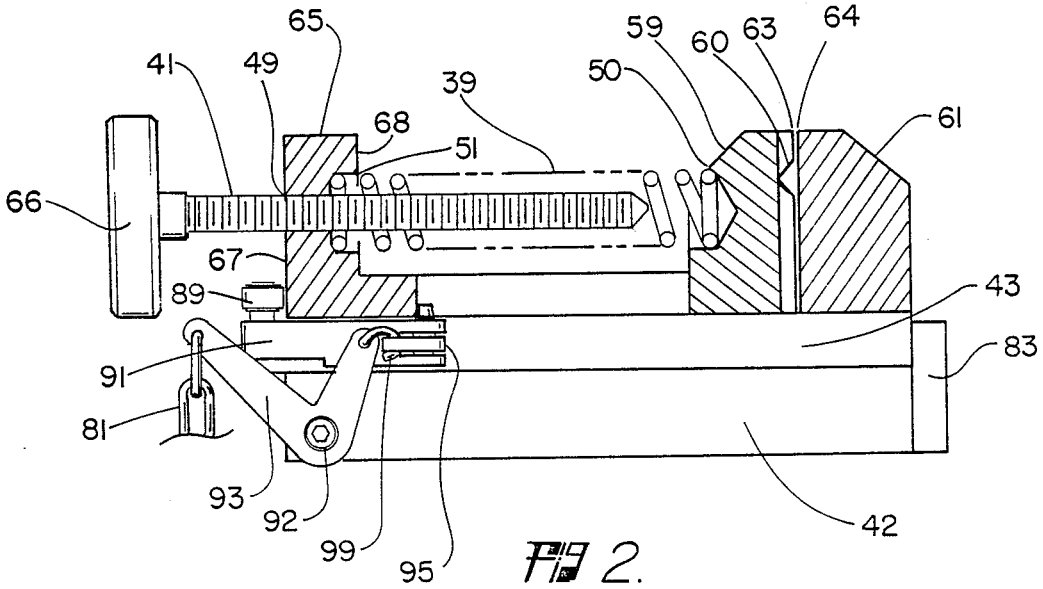
FIG. 2 Partially sectioned elevation of holding tool and vise combination.
Figure 3:
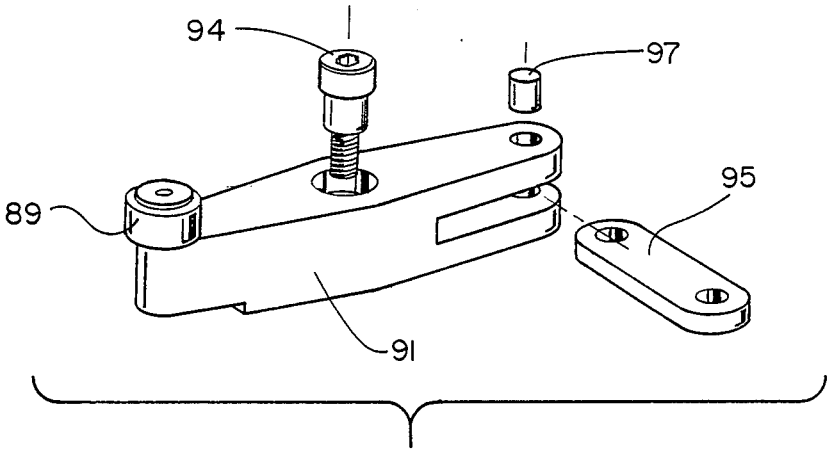
FIG. 3 Exploded view of horizontal pivot with shoulder bolt, clevis pin, clevis connector and bearing.
Figure 4:
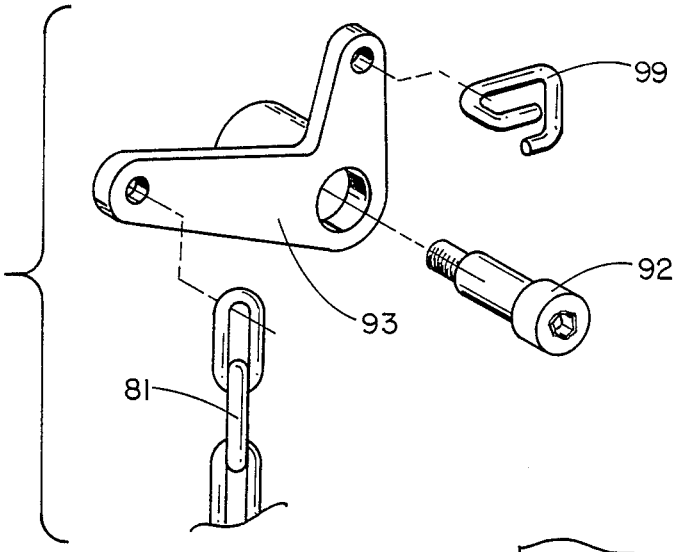
FIG. 4 Exploded view of vertical rocker with universal pivoting ring, foot pedal attachment and shoulder bolt.
Figure 5:
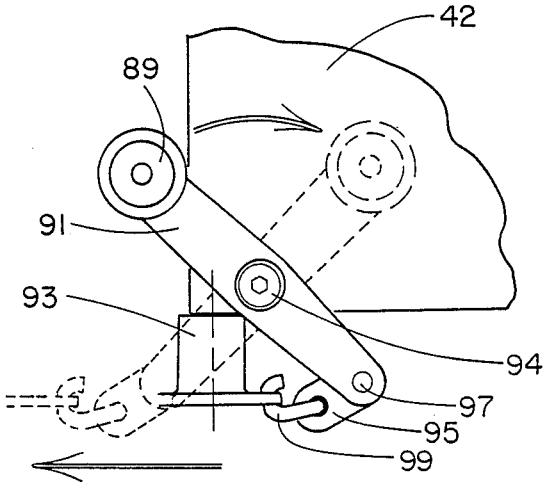
FIG. 5 Partial plan view of stationary base with assembled horizontal pivot, vertical rocker and foot operated attachment.

Referring to FIG. 1 and FIG. 2, the holding tool and vise combination consists of a stationary base 42 on which rests freely the secondary base 43, indexed by raised edge 83 of stationary base 42. Integral with secondary base 43 is the vertical stationary jaw 59 which has two equal and opposite rectangular cutouts on its bottom, a blind hole 50 in the center of its vertical face, and linear surface slots of triangular cross-section 60 located horizontally and vertically on its plane holding surface 63.

Slidably attached to secondary base 43 is the slotted slide 37 with two longitudinal webs 58, with which are integral at one longitudinal extremity the vertical moving jaw 61 and at the other extremity the vertical slide raise 65. Movable jaw 61 with plane holding surface 64 is located opposite stationary jaw 59 with plane holding surface 63, both jaws being equal and opposite, and the vise is formed by both holding surfaces 63 and 64.

Slide raise 65 at the center of its outside face 67 has threaded hole 49 which is countersunk from the inside face 68, forming the springholding countersink 51. The threaded shaft 41 with handle 66, threaded through hole 49, acts as the internal guide for the compression spring 39. The slotted slide 37 may also be constructed with a central sliding web instead of the two side webs 58.

The compression spring 39 is anchored at its one end in countersink 51 and at its other end in blind hole 50, both holes 50 and 51 being sized to receive the spring ends. Threaded shaft 41 may be screwably advanced until its tip reaches as far as hole 50, or retracted until the tip approaches inside face 68 of slide raise 65.

Figure 6:
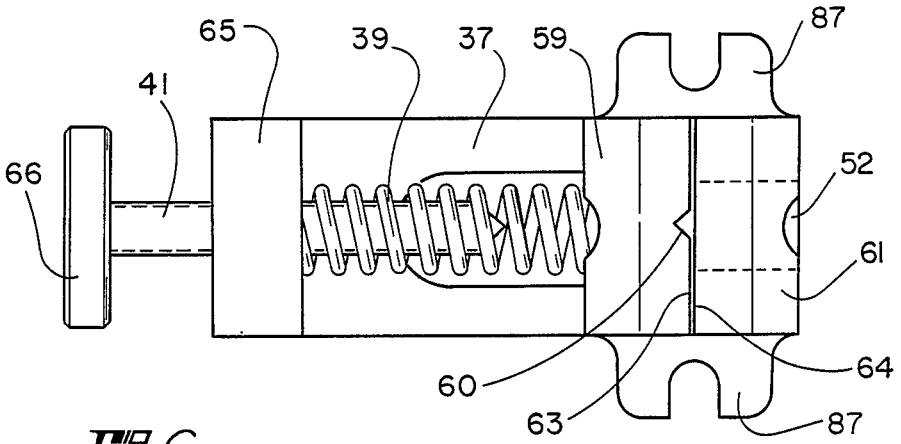
FIG. 6 Plan view of holding tool and vise combination.

Referring now to FIGS. 1 thru 5, there is attached to stationary base 42 the horizontal pivot 91 by vertical shoulder bolt 94. At one end of pivot 91 is attached a bearing 89, and at the other end a clevis pin 97 and clevis connector 95. At the vertical surface of base 42 is attached a vertical rocker 93 by means of horizontal shoulder bolt 92. Rocker 93 is shaped like a boomerang with included angle of the Vee-shape approximately 40 degrees. One extreme of the Vee is attached to the foot pedal extension 81, and the other extreme is attached to the clevis connector 95 by a universal pivot 99 which is an open double loop made of stiff wire or small diameter rod and twisted to make a 90 degree angle. The assembly of these parts translates vertical foot pedal motion to horizontal motion of bearing 89 to push slide 37. Referring now to FIG. 6, optional holding down tabs 87 are integral with stationary base 42, permitting the latter to be fixedly attached to a plane working surface such as a bench.

Figure 7:
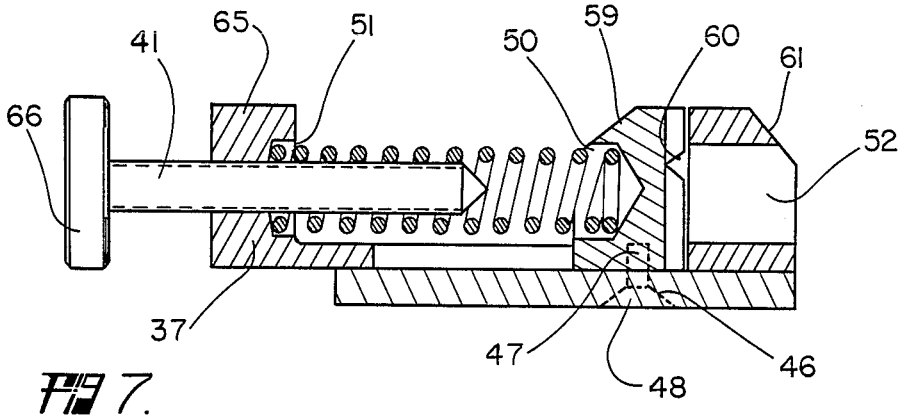
FIG. 7 Central cross section of elevation of holding tool and vise combination without stationary base.

Referring now to FIG. 6 and FIG. 7, an optional access hole 52 in movable jaw 61 facilitates countersinking hole 49 to produce seat 51 for spring 39.

Referring to FIG. 7, the fixed attachment of secondary base 43 to stationary jaw 59 by means of screws 48 threaded into countersunk holes 46 in base 43 and blind holes 47 in jaw 59 is shown.

Figure 8:
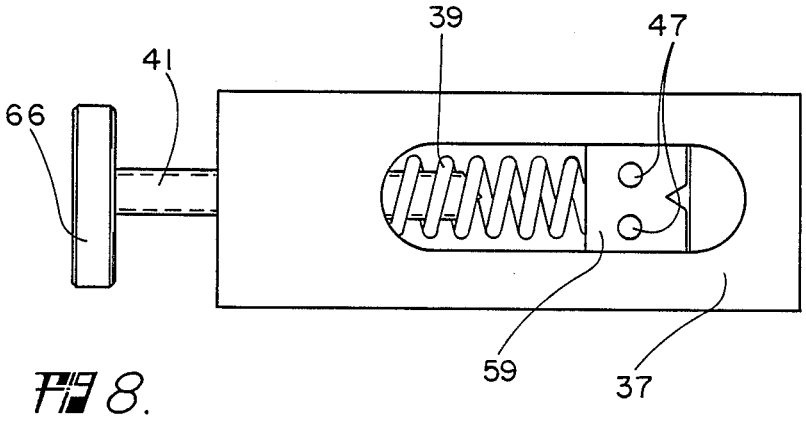
FIG. 8 Bottom view of slotted slide and stationary jaw.

Referring to FIG. 8, which is a bottom view of slotted slide 37 and stationary jaw 59, the blind threaded holes 47 in the underside of jaw 59 are shown. Alternative means of fixedly attaching jaw 59 to secondary base 43 are also possible. Further, a cylindrical rod may be substituted for threaded shaft 41, in which case the rod would slide in a smooth hole 49, with its position of advancement or retraction fixed by a set screw through a threaded hole drilled vertically downward from the top horizontal surface of slide raise 65.

The function of this holding tool and vise combination is to immobilize one or more objects or workpieces between jaws 59 and 61 through the compression of spring 39 and, if a stronger grip is desired, through the advancement of threaded shaft 41 for a positive vise grip or clamp. The operation of the invention will now be described step by step.

When not in use, jaws 59 and 61 are kept closed by compression of spring 39 which seeks to assume its fully extended length. To operate, jaws 59 and 61 are spread apart by two actions: (A) retracting threaded shaft 41 an amount at least equal to the jaw space required to accommodate the work piece(s), and (B) pushing slotted slide 37 forward by foot pedal action (via extension 81, vertical rocker 93, universal pivot 99, clevis connector 95, horizontal pivot 91 and bearing 89), the jaw opening being limited when the tip of shaft 41, which moves along with the slotted slide, reaches blind hole 50 in stationary jaw 59, at which point spring 39 is compressed by the amount of the jaw opening. In motion (B) the increasing compression of spring 39 forces secondary base 43 against raised edge 83 (integral with stationary base 42), and the slotted slide 37 (which is slidably connected to secondary base 43) further forward in a horizontal plane above the top of raised edge 83, unrestrained by edge 83 and beyond edge 83. The greater the retraction of shaft 41, the greater the achievable jaw opening. If shaft 41 is fully retracted, the jaw opening is limited by the complete compression of spring 39 when the spring coils are everywhere touching each other.

Next, while still exerting foot pedal action with jaws 59 and 61 opened, the work piece (or pieces) is inserted between the jaws, both hands being free to do this. By easing on the foot pedal and allowing the spring 39 to expand, the jaws close to hold the work piece. This is the "holding tool" position.

The foot pedal is now released completely, and, if desired, the assembly of secondary base 43, slotted slide 37 and work piece(s) may now be lifted off stationary base 42 for transfer to another work station. This illustrates the use of the invention as a holding tool, the work piece(s) being held solely under spring pressure.

If it is desired to use the invention as a vise, after the work piece is held under spring pressure, threaded shaft 41 is screwed forward until the shaft tip engages blind hole 50 in jaw 59, urging the jaws together for a vise grip. It is understood, of course, that the invention may omit the foot pedal actuation and motion (B) may be performed instead by pushing the slotted slide/threaded shaft assembly by applying pressure at shaft handle 66 with a body part (hand, chest) or any appendage which may be available, particularly with handicapped operators.

As before (holding tool position), the assembly now with the work piece(s) in the vise grip may be lifted off stationary base 42 to another work station. If such a transfer is not planned, stationary base 42 and secondary base 43 may be firmly attached to each other, leaving the slotted slide 37 as the only movable component.

The preferred embodiment has now been described, but it should be understood that the invention can be practised in other realizations without departing from its essential features, or changing the scope of the invention as defined in the claims.

I claim:

1. A holding tool and vise combination suitable for holding, adjusting and clamping a work piece by independent use of a foot pedal and the operator's hands, the combination comprising a stationary base with a raised edge;

a secondary base resting on the stationary base and removable therefrom;

a stationary jaw integral with the secondary base;

a slotted slide slidably attached to the secondary base;

a movable jaw integral with the slotted slide at its one extremity;

a slide raise integral with the slotted slide at its other extremity;

a spring means acting to spread apart the stationary jaw and the slide raise and thereby providing a holding force to push together the movable jaw and the stationary jaw to hold the work piece;

a clamping means to proivde a rigid vise grip on the work piece between the stationary jaw and the movable jaw independent of the spring means; and a linkage means to translate the vertical motion of the foot pedal to horizontal motion of the slotted slide in a direction moving the movable jaw away from the stationary jaw to open the gap between the jaws to admit the work piece, thereby compressing the spring means.

2. The combination of claim 1 wherein the spring means is a cylindrically wound spiral spring extending between the slide raise and the stationary jaw.

3. The combination of claim 1 wherein the clamping means is a threaded shaft with a handle at one end and a tip at the other end, screwably mounted in a matching threaded hole in the slide raise, such that the shaft tip may be advanced to bear against the stationary jaw for a positive vise grip on the work piece.

4. The combination of claim 1 wherein the linkage means is an actuator system comprising a foot pedal extension connected to a vertical rocker which is connected to a universal pivot, a clevis connector is connected to a horizontal pivot which is connected to a bearing, with the bearing pushing against the slotted slide when the foot pedal is actuated.

5. In a holding tool and vise combination suitable for holding, adjusting and clamping a work piece by independent use of a foot pedal and the operator's hands, the combination comprising a stationary base with a raised edge;

a secondary base resting on the stationary base and removable therefrom;

a stationary jaw integral with the secondary base;

a slotted slide slidably attached to the secondary base;

a movable jaw integral with the slotted slide at its one extremity;

a slide raise integral with the slotted slide at its other extremity;

a cylindrically wound spiral spring extending between the slide raise and the stationary jaw;

a threaded shaft with a handle at one end and a tip at the other end, screwably mounted in a matching threaded hole in the slide raise, with the tip toward the stationary jaw; and an actuator system comprising a foot pedal extension, a vertical rocker, a universal pivot, a clevis connector, a horizontal pivot, and a bearing, with the bearing pushing against the slotted slide when the foot pedal is depressed:

the method for holding, adjusting, clamping and transporting a work piece comprising the steps (a) retracting the threaded shaft by rotation of the handle by an amount exceeding the size of the work piece to be held:

(b) depressing the foot pedal to cause the actuator system to push forward the slotted slide and thus spread apart the movable jaw and stationary jaw until the gap between said jaws exceeds the size of the work piece, thus also partially compressing the spiral spring and partially advancing the tip of the threaded shaft;

(c) inserting the work piece by hand into the oversize gap between the stationary jaw and the movable jaw and holding the work piece there by hand;

(d) releasing the foot pedal and allowing the compression of the spiral spring to push back the slotted slide, thereby causing the movable jaw to approach the stationary jaw and hold the work piece under spring pressure;

(e) removing the hands from the work piece which is now held solely by spring pressure without hand or foot action;

(f) to adjust the position of the work piece, holding the work piece by hand, depressing the foot pedal as in step (b) to spread apart the stationary jaw and movable jaw, re-positioning the work piece by hand in the oversize gap, releasing the foot pedal as in step (d) and removing the hands as in step (e);

(g) advancing the threaded shaft by rotation of the shaft handle until the shaft tip presses against the stationary jaw, overriding the spring pressure, to clamp the work piece in a positive vise grip;

(h) to adjust the position of the work piece after being clamped between the stationary jaw and movable jaw, performing steps (a), (f) and (g) in that order to re-clamp the work piece; and (i) to transport the clamped work piece, lifting off the stationary base the assembly of secondary base, slotted slide and clamped work piece and carrying the assembly elsewhere for further operations.

* * * * *